US006105584A

United States Patent [19]

Williams

[11] Patent Number: 6,105,584

[45] Date of Patent: Aug. 22, 2000

[54] SIZE ADJUSTABLE HAIR-ENHANCING CAP

[76] Inventor: Raymond Williams, 1231 NW. 137th St., Apt. 365-F, Boca Raton, Fla. 33486

[21] Appl. No.: 09/114,325

[22] Filed: Jul. 13, 1998

[51] Int. Cl.[7] ..... A41G 3/00; A41G 5/00

[52] U.S. Cl. ..... 132/53; 132/54; 132/55; 132/56

[58] Field of Search ..... 132/53, 54, 55, 132/56, 200, 201

[56] References Cited

U.S. PATENT DOCUMENTS

| | | | |
|---|---|---|---|
| 1,545,881 | 7/1925 | Cohen | 132/54 |
| 3,834,403 | 9/1974 | Ahn | 132/53 |
| 3,884,248 | 5/1975 | Mendelson et al. | 132/53 |
| 4,150,678 | 4/1979 | Photopulos | 132/53 |
| 4,386,619 | 6/1983 | Williams | 132/53 |
| 4,658,841 | 4/1987 | Won | 132/53 |
| 5,562,111 | 10/1996 | Torres | 132/54 |
| 5,647,384 | 7/1997 | Haber et al. | 132/54 |
| 5,873,373 | 2/1999 | Narvick | 132/54 |

FOREIGN PATENT DOCUMENTS

| | | | |
|---|---|---|---|
| 3542123 | 6/1987 | Germany | 132/53 |

*Primary Examiner*—John J. Wilson
*Assistant Examiner*—Robyn Kieu Doan
*Attorney, Agent, or Firm*—Oltman, Flynn & Kubler

[57] ABSTRACT

An adjustable hairpiece includes a flexible perimeter member for fitting around the head of a wearer; a hair mounting structure; a draw member extending across at least one point on the perimeter member; a draw string member fastener for securing the draw member to the flexible perimeter member at any one of several longitudinally distributed points along the draw member; and several hairlike strands connected to the hair mounting structure. The hairpiece preferably additionally includes first and second laterally spaced apart guide lines connected to and extending between two spaced apart points on the perimeter member, where the draw string member includes a first draw string line wrapping around the first and second guide lines in a spiral fashion in one direction.

16 Claims, 14 Drawing Sheets

SIDE VIEW

ADJUSTABLE ONE SIZE FITS ALL

SIZE ADJUSTABLE HAIR-ENHANCING CAP

BACKGROUND OF THE INVENTION

1. Field of the Invention

The present invention relates generally to the field of hair replacement devices such as wigs. More specifically the present invention relates to a hairpiece which takes the form of either a intersperser including a network of flexible lines crocheted with rows of hair strands for interspersing with wearer hair, or takes the form of a wig for covering a region of the head, and which includes draw line means for sizing the hairpiece to custom fit an individual head. A custom fit embodiment of the filler is provided which draws evenly and uniformly against the wearer head during fitting, and to which hair strands are subsequently attached according to the specific needs of the particular wearer. A stock embodiment of the intersperser is further provided to which the hair strands are already attached and which draws against the wearer head during fitting to an approximated close fit for immediate use and minimized cost. Finally a wig embodiment is provided which draws uniformly around and against the wearer head and fully covers all or a portion of the head with hair strands.

2. Description of the Prior Art

There have long been hairpieces for covering thin and bald areas of wearer heads with real or simulated hair strands. One hairpiece, disclosed in U.S. Pat. No. 4,386,619 issued on Jun. 7, 1983 to the present applicant, provides a network of lines to which hair strands are attached for fitting between and interspersing with existing wearer hair to supplement and add fullness to existing hair. A problem with these prior hairpieces has been that they do not always fit the wearer head closely and evenly, so that a fully convincing and natural look is not always achieved.

It is thus an object of the present invention to provide a hairpiece which either entirely covers an area of a wearer head with hair strands or which intersperses hair strands with existing wearer hair for a fuller and natural look.

It is another object of the present invention to provide a custom version of such a hairpiece which has size adjustment means to be drawn to very closely and evenly fit the wearer head, and to which hair stands are subsequently added as needed by the particular wearer.

It is still another object of the present invention to provide a stock hairpiece which has hair strands already attached and has size adjustment means to be drawn reasonably closely around the particular wearer head by store personnel, for rapid fitting and low cost.

It is a still further object of the present invention to provide a hairpiece which covers the hair on at least a portion of the wearer head entirely in the manner of a wig.

It is finally an object of the present invention to provide such a hairpiece which is inexpensive to manufacture, sturdy and reliable.

SUMMARY OF THE INVENTION

The present invention accomplishes the above-stated objectives, as well as others, as may be determined by a fair reading and interpretation of the entire specification.

An adjustable hairpiece is provided, including a flexible perimeter member for fitting around the head of a wearer; a hair mounting structure; a draw member extending across at least one point on the perimeter member; a draw string member fastener for securing the draw member to the flexible perimeter member at any one of several longitudinally distributed points along the draw member; and several hairlike strands connected to the hair mounting structure.

The hairpiece preferably additionally includes first and second laterally spaced apart guide lines connected to and extending between two spaced apart points on the perimeter member, where the draw string member includes a first draw string line wrapping around the first and second guide lines in a spiral fashion in one direction, and wrapping around the first guide line and an opposing first segment of the perimeter member in a spiral fashion, so that pulling an end of the draw string line draws the guide lines toward each other and draws the first guide line and the first segment of the perimeter member toward each other, to fit the hairpiece to the head of a wearer. The mounting structure preferably includes the draw member. The hairpiece optionally additionally includes a second draw string line where the second draw string line wraps around the guide lines in a spiral fashion in one direction, and wraps around the second guide line and an opposing second segment of the perimeter member in a spiral fashion, so that pulling an end of the second draw string line draws the guide lines toward each other and draws the second guide line and the second segment of the perimeter member toward each other, to fit the hairpiece to the head of a wearer.

The perimeter member preferably includes an elongate mesh member having a longitudinal series of mesh member ports for receiving the first and second draw string lines. The perimeter member preferably further includes an elastic segment for drawing the perimeter member snugly around the head of wearer. The draw member fastening mechanism optionally includes a knot tied in the draw string line.

The hairpiece preferably additionally includes lines of wefting between which the hair strands of a wearer passes, and several hairlike strands are preferably mounted onto the lines of wetting in elongate rows for interspersion among hair strands of the wearer. The draw member preferably includes a flexible strip extending radially across the perimeter member. The draw member fastening mechanism optionally includes a longitudinally spaced series of hook and loop fastener patches secured to the flexible strip, and the perimeter member optionally includes a hook and loop fastener strip for engaging the hook and loop fastener patches. The hairpiece optionally additionally includes a central scalp loop member secured to, and from which, the flexible strip extends.

The hairpiece optionally additionally includes netting secured to and extending within the central scalp loop member. The hairpiece optionally includes several of the flexible strips. The hair mounting structure optionally includes a flexible hair mounting sheet for covering at least a portion of the wearer scalp, and the hairlike strands preferably cover at least a portion of the mounting sheet. The hairpiece optionally additionally includes a mounting sheet flap intersecting and connected to the mounting sheet and covered at least in part by the hairlike strands and extending over the perimeter member for concealing the perimeter member. The hairlike strands are optionally human hair segments.

The hairpiece optionally additionally includes first and second laterally spaced apart guide lines connected to and extending between two spaced apart points on the perimeter member, and the draw member optionally includes a first draw string line wrapping around the first and second guide lines in a spiral fashion in one direction.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
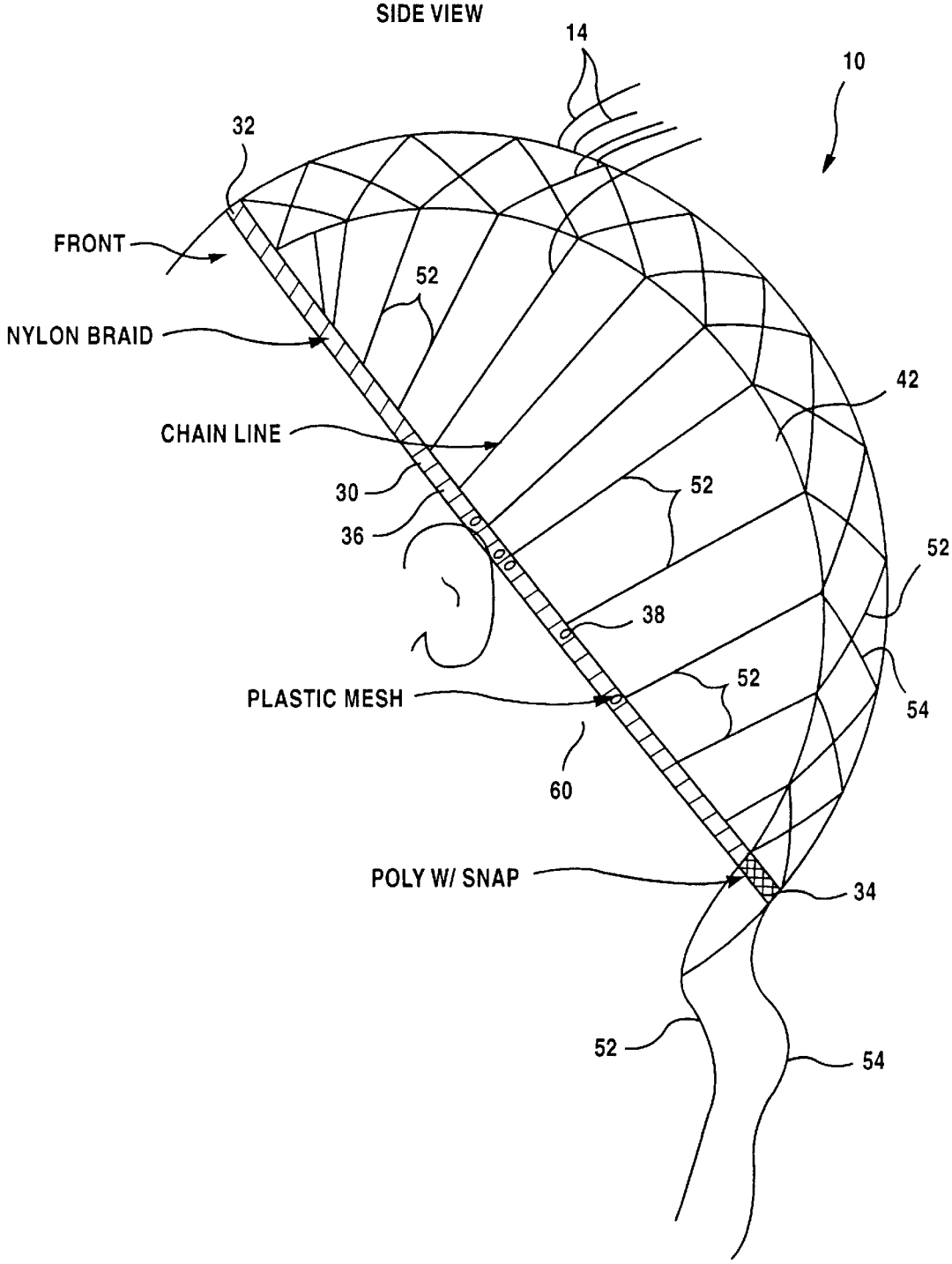
FIG. 1 is a side view of the first embodiment of the intersperser hairpiece mounted on a form head, producing a custom fit.
Figure 2:
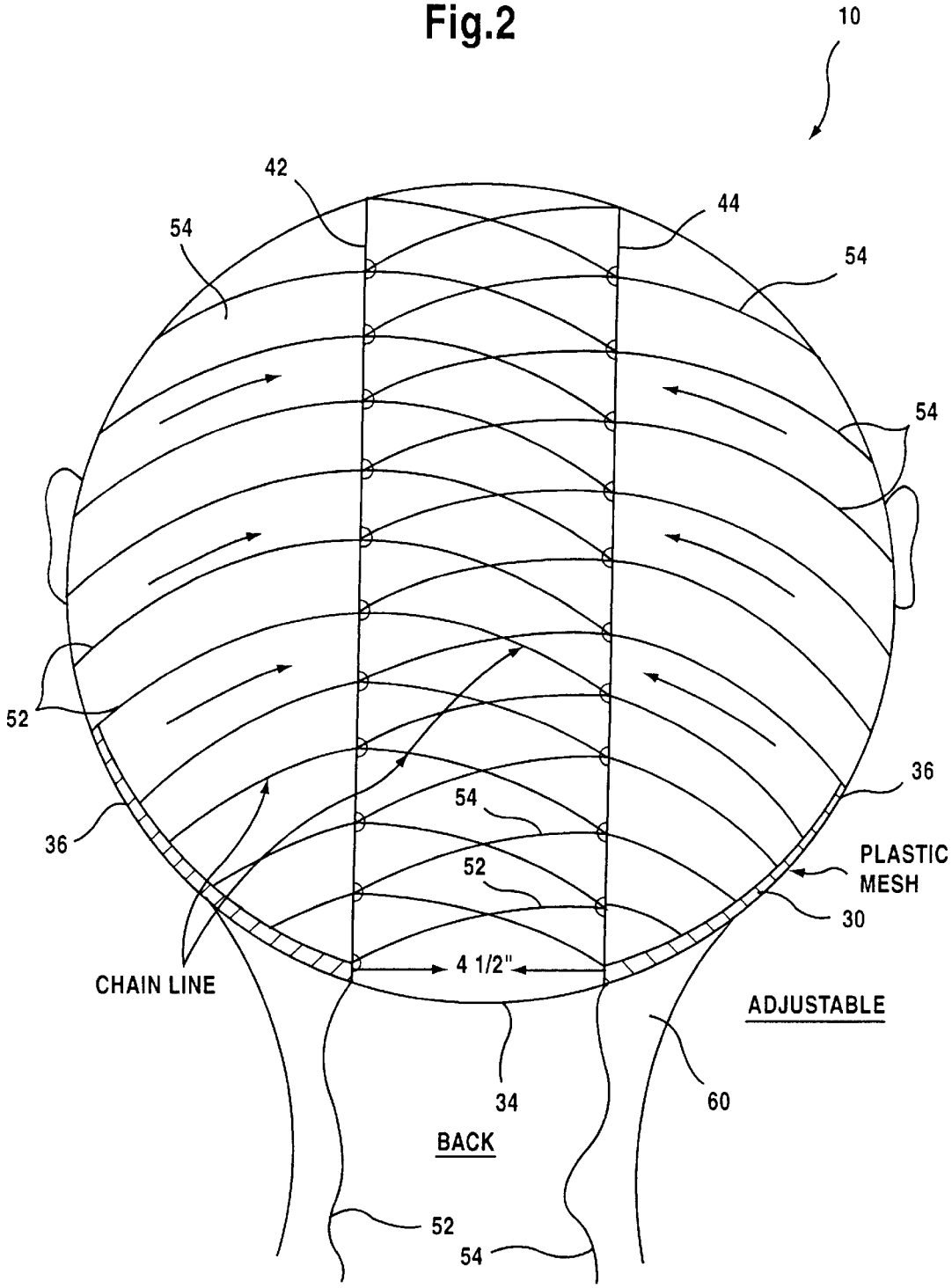
FIG. 2 is a top view of the hairpiece of FIG. 1, illustrating the paths two draw string lines.
Figure 3:
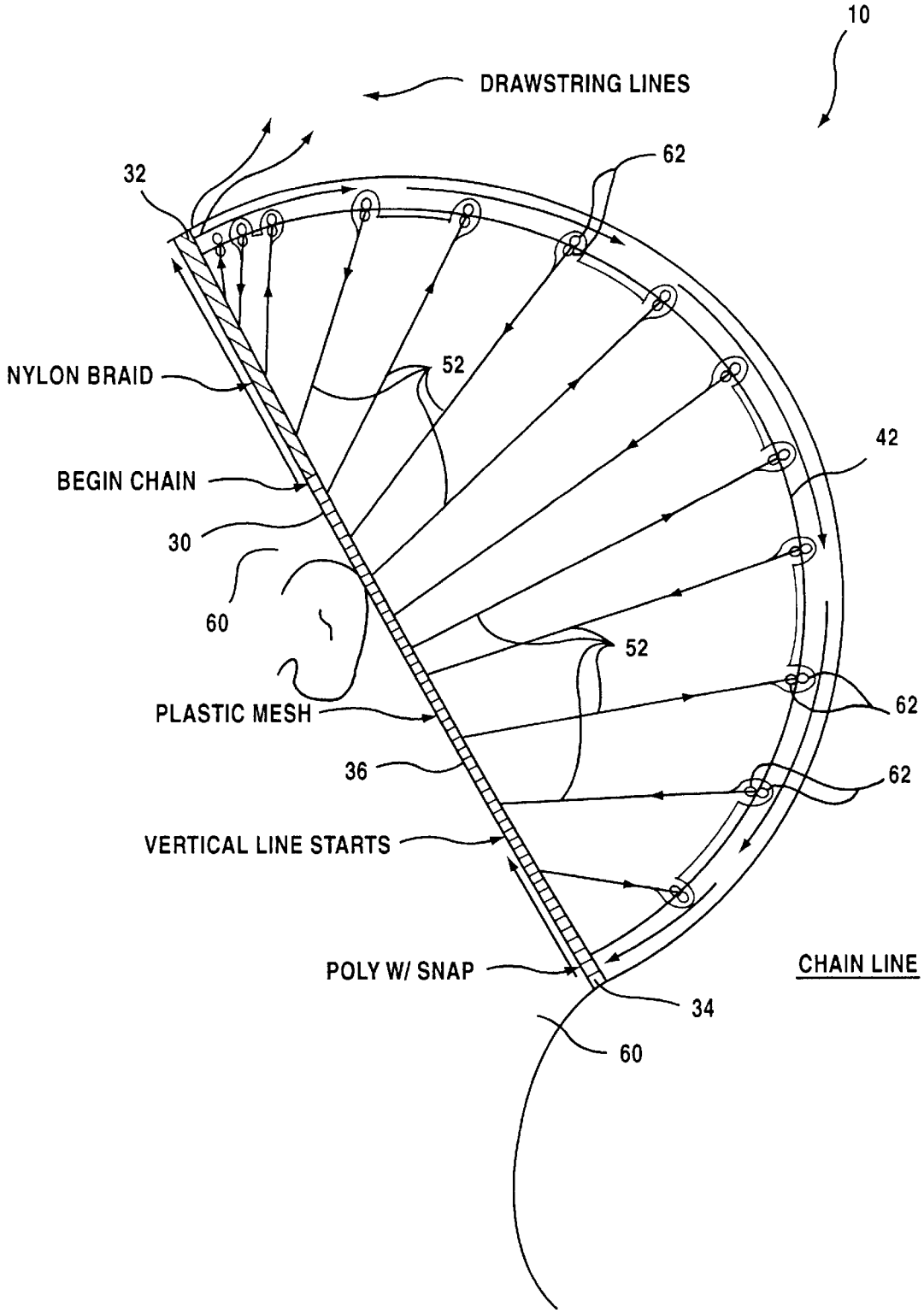
FIG. 3 is a side view of the embodiment of FIG. 1, showing the series of double pins between which the guide lines extend and around which the drawstring lines are wrapped during hairpiece assembly.
Figure 4:
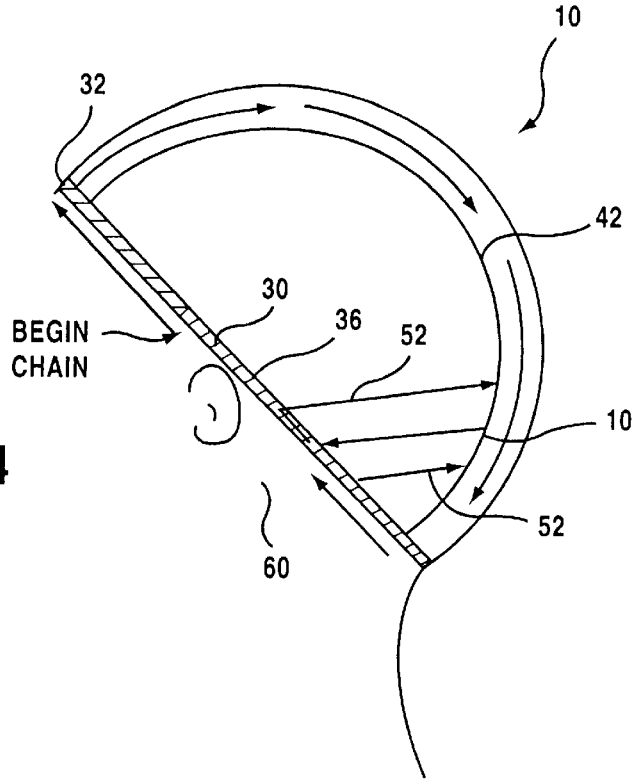
FIG. 4 is a side view of the embodiment of FIG. 1, with the draw string lines partly strung on the form head.
Figure 5:
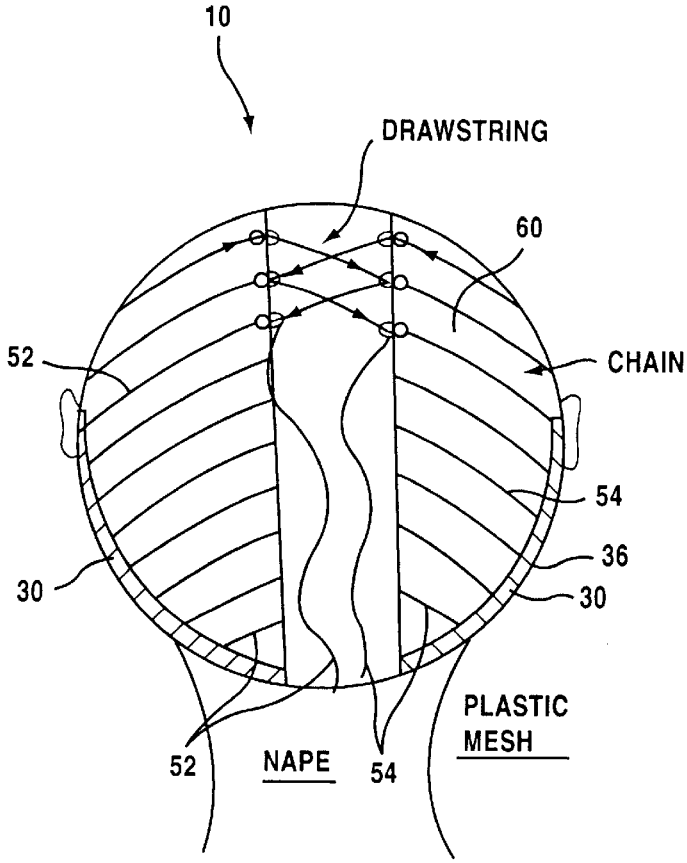
FIG. 5 is a top view of the embodiment of FIG. 4, with the draw string lines further partly strung.
Figure 6:
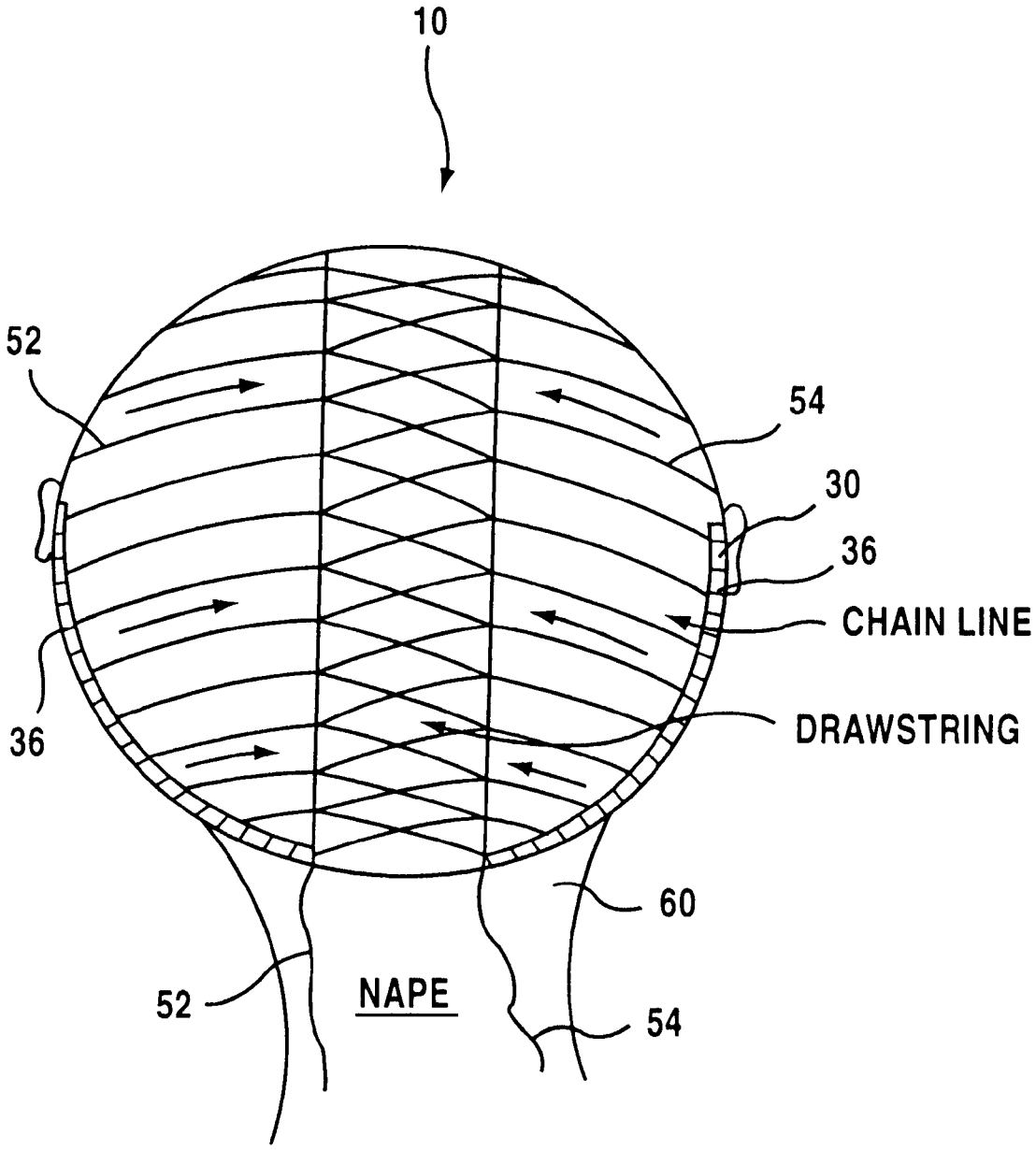
FIG. 6 is a top view as in FIG. 5, with the draw string lines fully strung.
Figure 7:
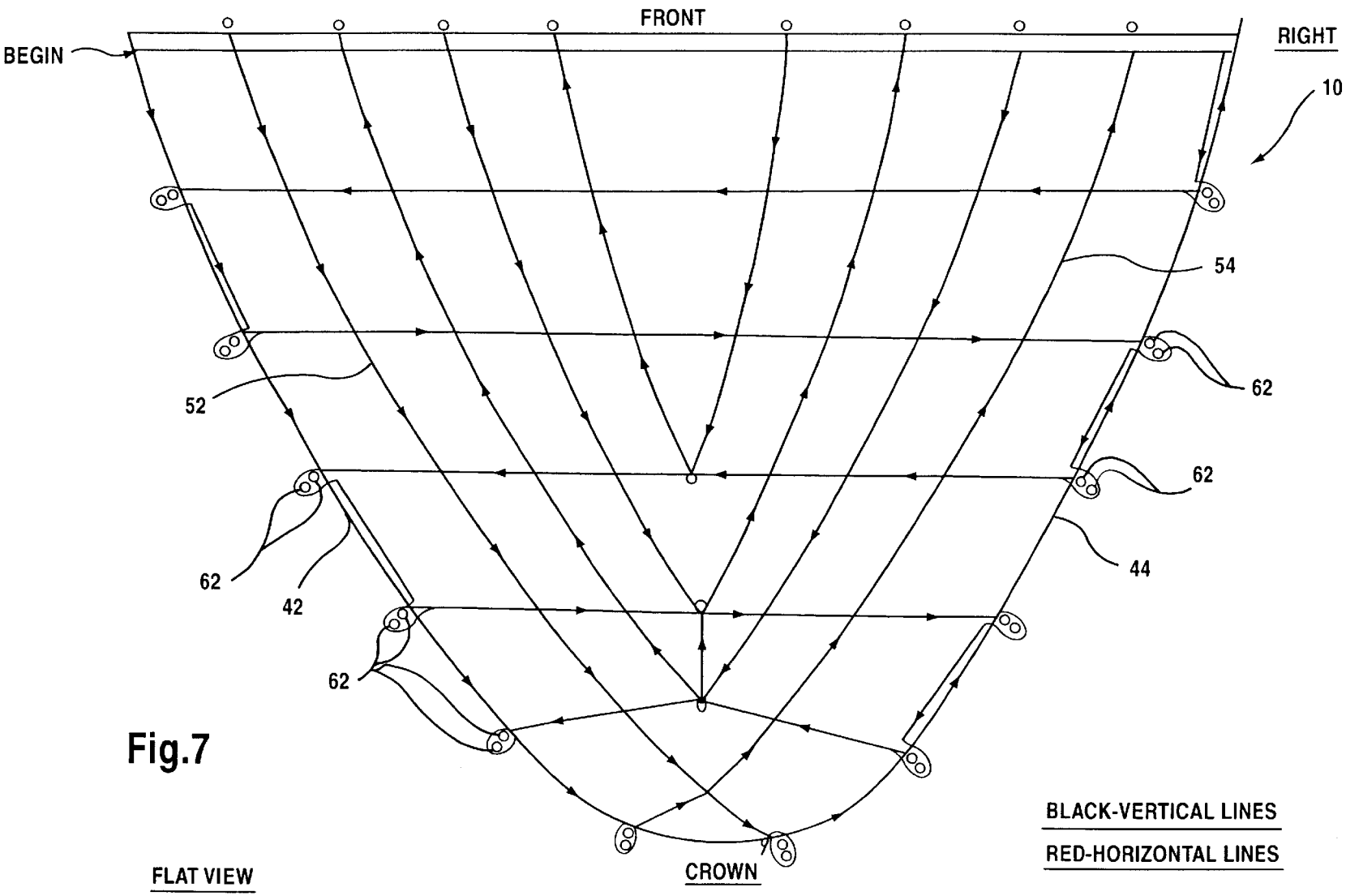
FIG. 7 is a flat view of the lines of the first embodiment of the hairpiece.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–7, a hairpiece is disclosed which for one embodiment takes the form of an intersperser 10 having a network of lines crocheted with hair strands 14 for interspersing rows of hair within thinning hair on a wearer head. Other embodiments explained below include a wig 210 for entirely covering a region of the head. All embodiments include draw string line means for sizing hairpiece 10 to custom fit an individual wearer head.

A custom fit embodiment of intersperser 10 includes a peripheral member in the form of a loop line 30 for fitting around the wearer head. Loop line 30 includes a loop line forward segment 32 formed of nylon braid for crossing over the wearer forehead, a loop line rearward segment 34 formed of elastic material for crossing over the upper neck area, and left and right loop line side segments 36 formed of plastic mesh having longitudinal arrays of regularly spaced mesh ports 38. First and second parallel and spaced apart longitudinal guide lines 42 and 44, respectively, extend from loop line forward segment 32 rearwardly over the top of the wearer head and connect to rearward segment 34. First and second draw string lines 52 and 54, respectively, wind around loop line 30 and guide lines 42 and 44 to draw the intersperser 10 snugly and evenly around the wearer head for a custom fit.

First draw string line 52 begins at the intersection of first guide line 42 and loop line rearward segment 34, and second draw string line 54 begins at the intersection of second guide line 44 and loop line rearward segment 34. First draw string line 52 crosses above loop line 30 and folds around the outside of first guide line 42 adjacent to loop line 30. First draw string line 52 crosses the space between guide lines 42 and 44 while advancing forwardly, then folds around the outside of second guide line 42 and then crosses back over the space between guide lines 42 and 44 while advancing forwardly, again folding around the outside of first guide line 42. First draw string line 52 continues in this crossing and wrapping pattern until it reaches loop line forward segment 32, where it passes through the nylon braid.

First draw string line 52 through a port 38 and then extends through the nylon braid of forward segment 32. First draw string line 52 continues upward to first guide line 42 where it folds around itself at the forwardmost point where it crosses and folds around first guide line 44. Then first draw string line 52 extends back toward loop line 30, while advancing rearwardly, and passes again through the nylon braid. From there, first draw string line 52 extends again to first guide line 42 and rearwardly and again folds around itself at the next forwardmost point where it crosses and folds around first guide line 42. This pattern continues rearwardly, and when first draw string line 52 reaches the rearward end of the nylon braid of forward segment 32, it passes through mesh ports 38 in the plastic mesh forming loop line side segments 36. Below the point where first draw string line 52 folds around the rearmost end of first guide line 42, it trails behind first guide line 42, over and downward from loop line 30, to a length suitable for hand gripping for drawing.

Second draw string line 54 follows a mirror image of the first draw string line 52 pattern, first advancing forwardly and crossing between first and second guide lines 42 and 44, respectively, folding around guide lines 42 and 44 at points midway between the points at which first draw string line 52 folds around guide lines 42 and 44. Then second draw string line 54 advances rearwardly and crosses between a second side loop line segment 36 and second guide line 44, where it trails downwardly over and beyond loop line 30.

During manufacture, loop line 30 and guide lines 42 and 44 are preferably fitted around a form head 60 made of canvass, and a series of pins 62 having pin heads are inserted into form head 60 adjacent to and outside guide lines 42 and 44 for draw string lines 52 and 54 to wrap around as they fold around guide lines 42 and 44 so that guide lines 42 and 44 are not distorted and displaced during network assembly.

To custom fit the intersperser 10 to a wearer head, the intersperser 10 line network is fitted onto the head and the lines 30–36, 42 and 44 and 52 and 54 are fitted between rows of wearer hair strands to a position substantially against the scalp. Then the trailing ends of first and second draw string lines 52 and 54 are pulled outwardly and downwardly from loop line 30 so that the top and side portions of the line network close substantially uniformly and evenly around and against the wearer scalp to a desired snugness. Then draw string lines 52 and 54 are permanently tied to loop line 30. Once this is accomplished, the line network is removed from the wearer head and hair strands 14 of real or artificial hair are secured to draw string lines 52 and 54 and to guide lines 42 and 44 where needed by the particular wearer to fill thinning areas. Hair strands 14 are preferably secured by crocheting and may either duplicate the color of the wearer hair or may be lighter to provide a frosted effect.

Second Preferred Embodiment

Figure 8:
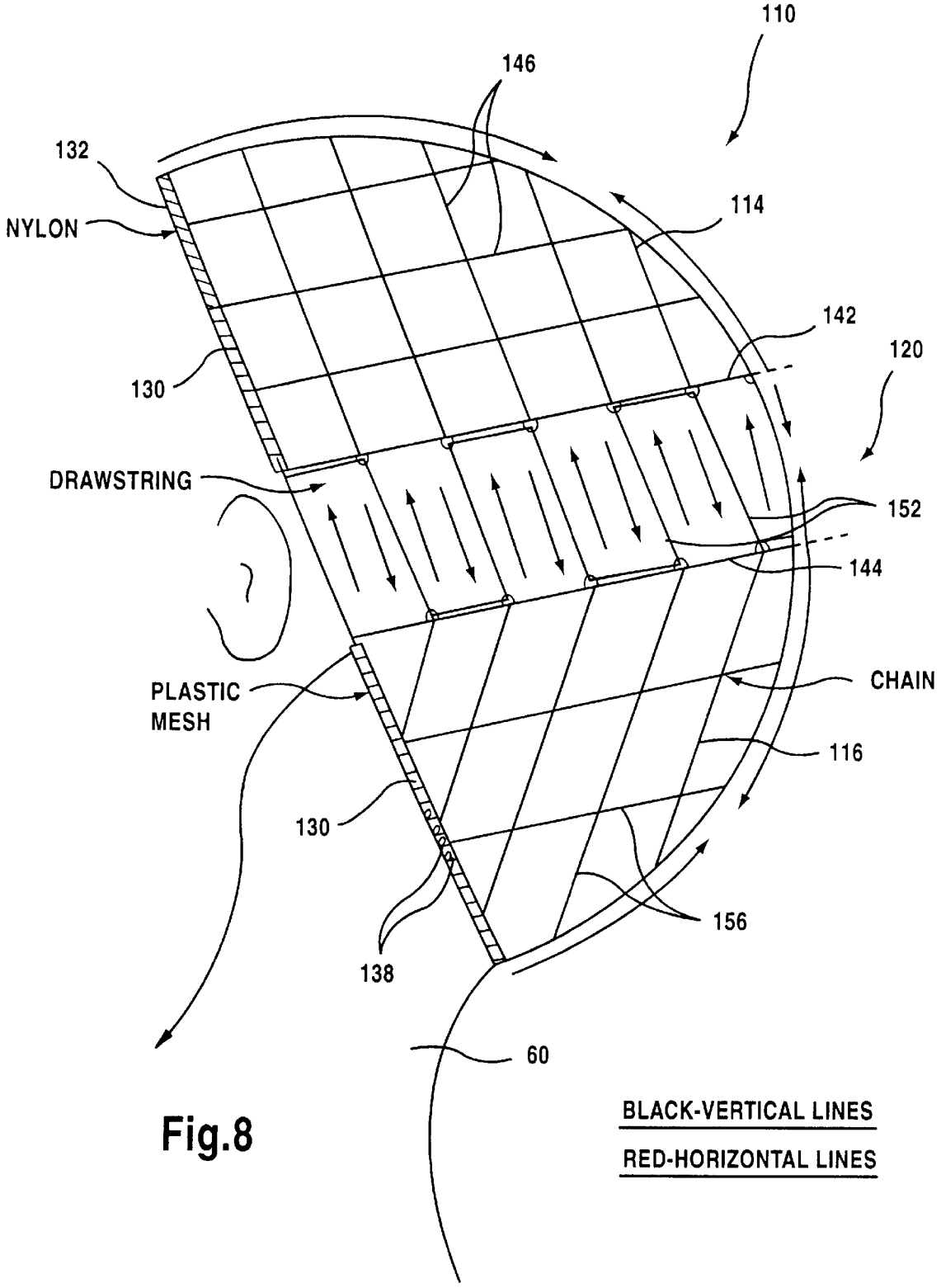
FIG. 8 is a side view of the second embodiment of the intersperser hairpiece mounted on a form head, producing a stock fit, and showing with arrows the movement of the draw string lines during fitting to a wearer head.

A stock embodiment intersperser 110 is provided as well. The custom fit embodiment of intersperser 110 cannot be simply fitted to the head of a wearer by a store clerk and sold, because the hair strands 14 must be secured to the line network after fitting. See FIGS. 8–10. Otherwise the protruding hair strands 14 would prevent draw string lines 52 and 54 from sliding around themselves and around guide lines 42 and 44 during fitting. Thus, for the off-the-shelf market, a stock embodiment is provided which may be fitted to the wearer head with the hair strands 14 already attached. Stock filler 110 does not fit quite as closely and quite as evenly to the head as does custom fit intersperser 10, but it does permit the wearer to be fitted and to leave with the fitted hairpiece 10 in a single, brief store visit and at lower cost.

The stock embodiment of intersperser 110 includes an upper net region 114 and a lower net region 116, net regions 114 and 116 being separated by a space 120 of substantially continuous width extending from behind one wearer ear to behind the other wearer ear. Along the inward edges of each of upper and lower net regions 114 and 116 adjacent to space 120 are first and second guide lines 142 and 144, respectively. The width of space 120, and thus the head size of the hairpiece 10, is adjustable with size adjustment means in the form of a draw string line 152 weaving back and forth across space 120 around first guide line 142 to second guide line 144 along the length of space 120, so that pulling draw string line 152 ends extending from each longitudinal end of space 120 draws upper and lower net regions 114 and 116 closer together.

Figure 9:
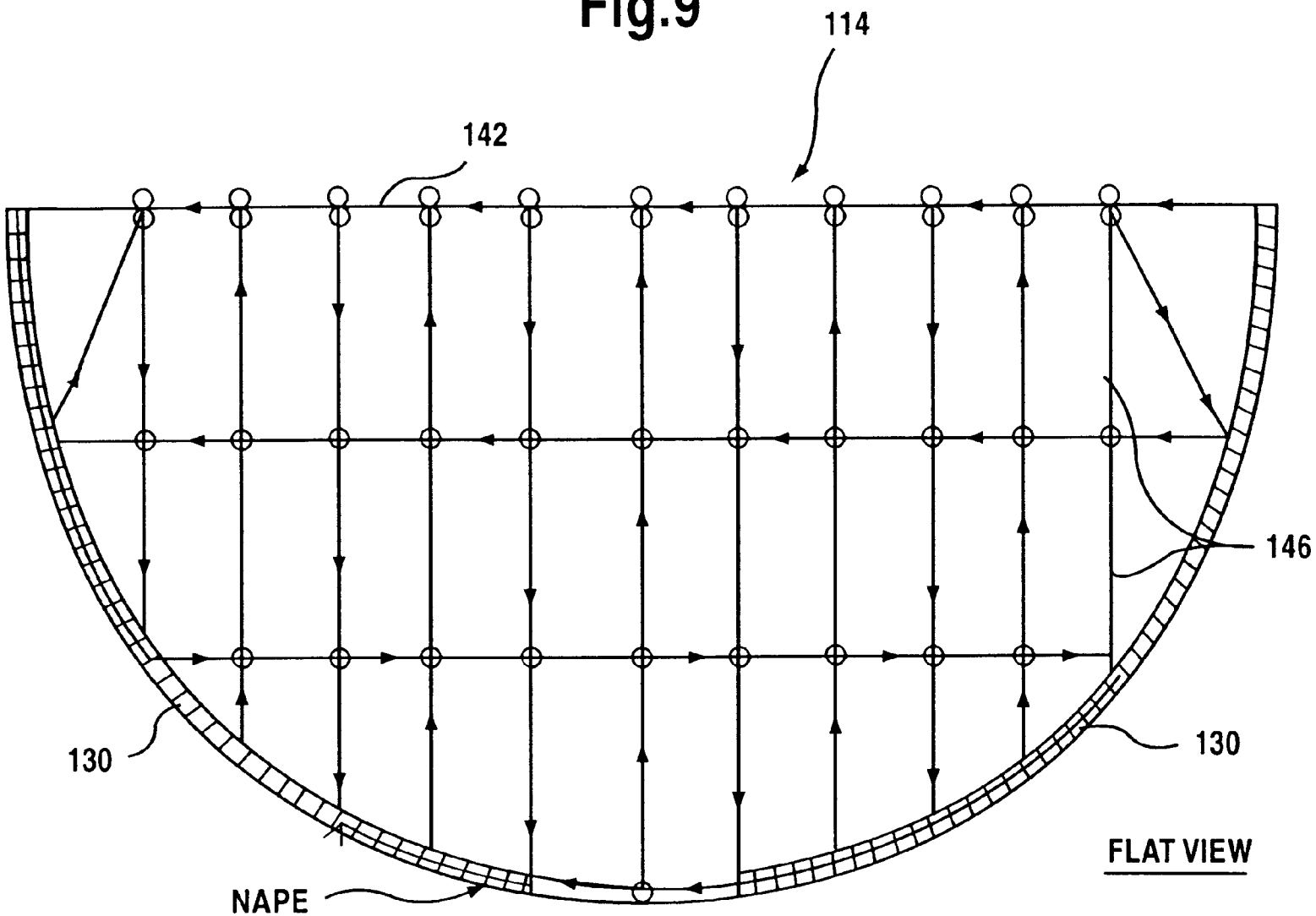
FIG. 9 is a flat view of the lower or upper region of the embodiment of FIG. 8.
Figure 10:
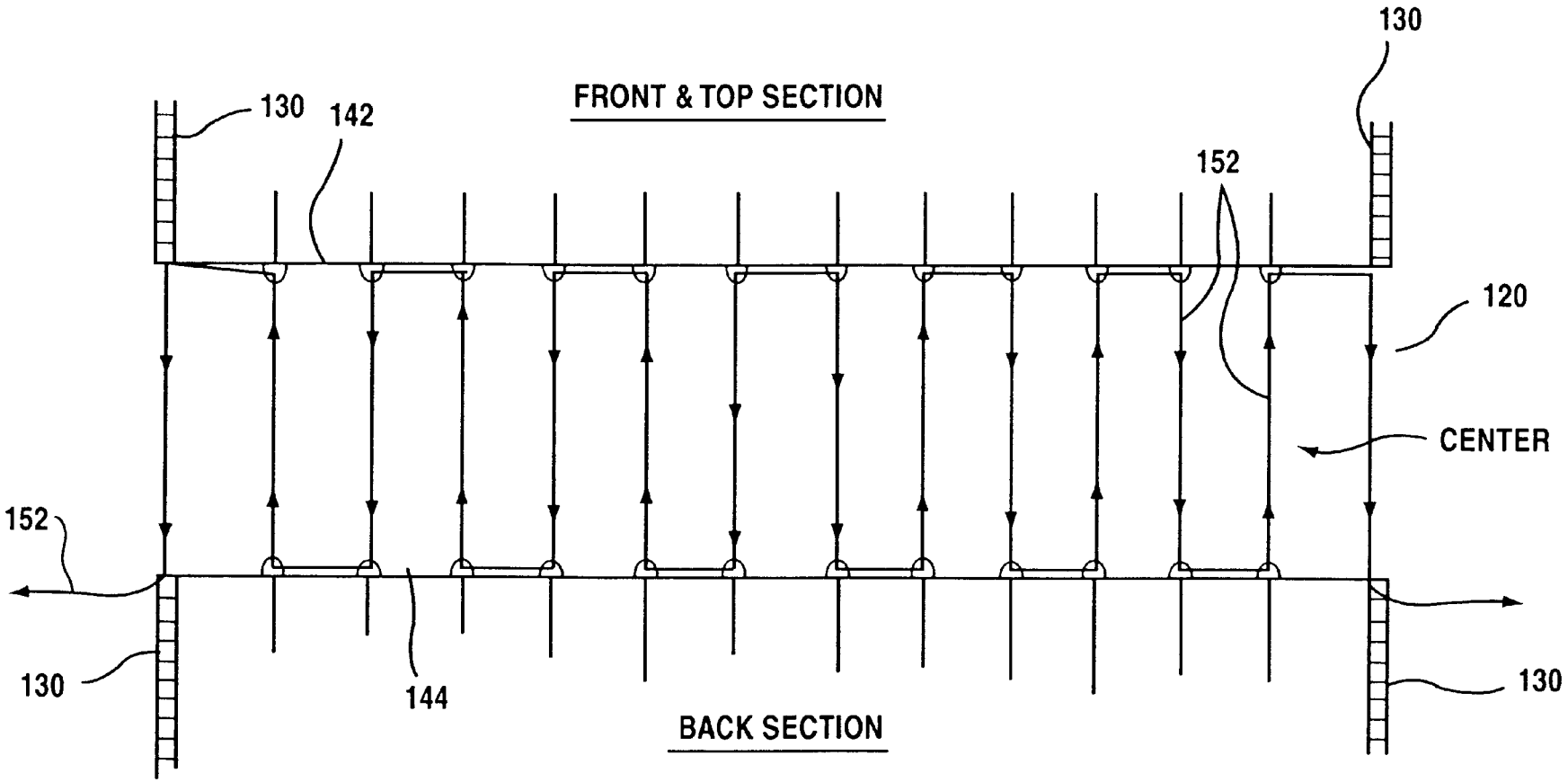
FIG. 10 is a broken away view of the drawstring portion of the embodiment of FIG. 8.
Figure 11:
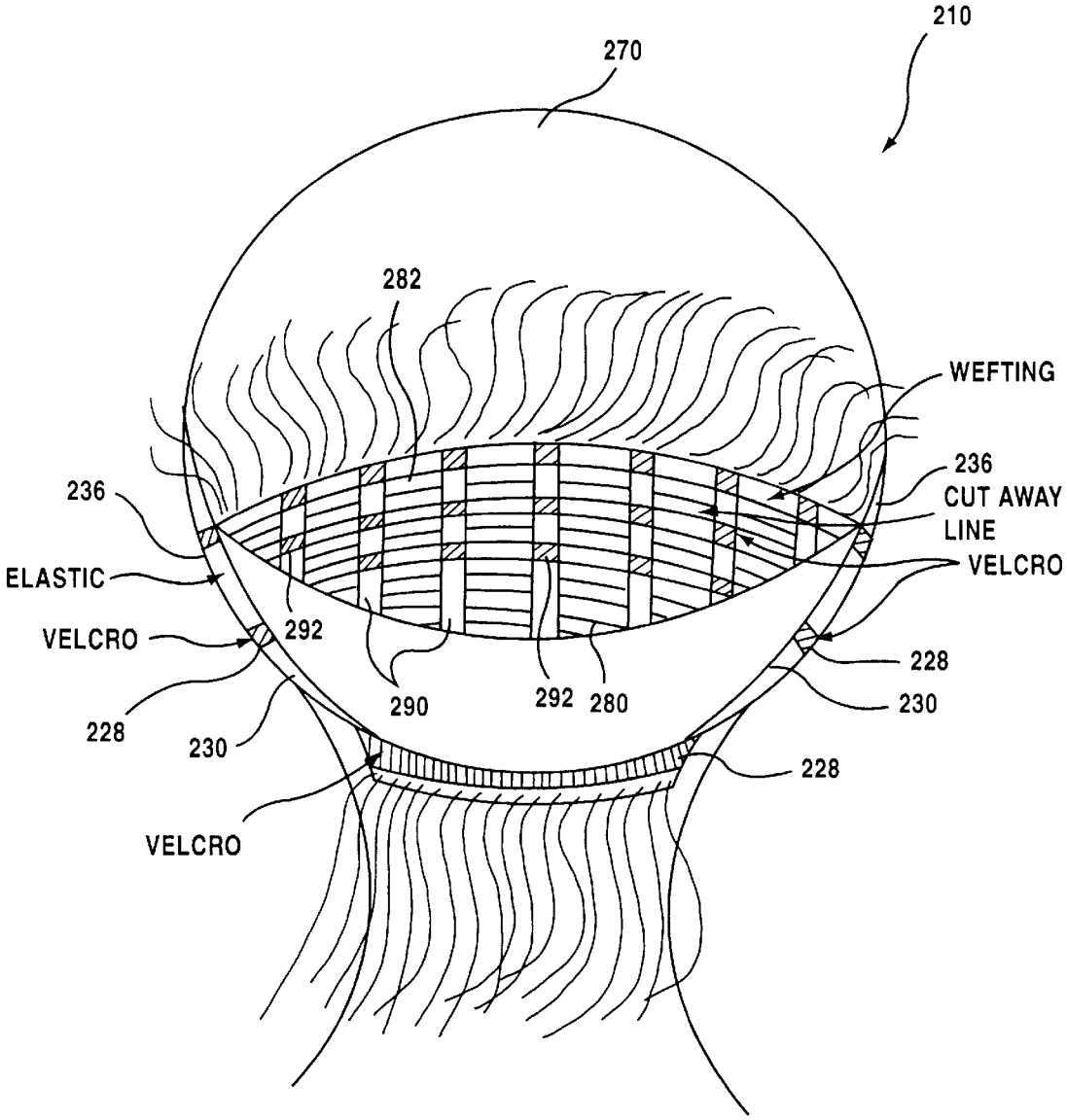
FIG. 11 is a rear view of the third embodiment of the wig hairpiece mounted on a form head, with the hair segment mounting sheet pulled upward to reveal the wefting and loop member, and showing the hook and loop fastener patches.
Figure 12:
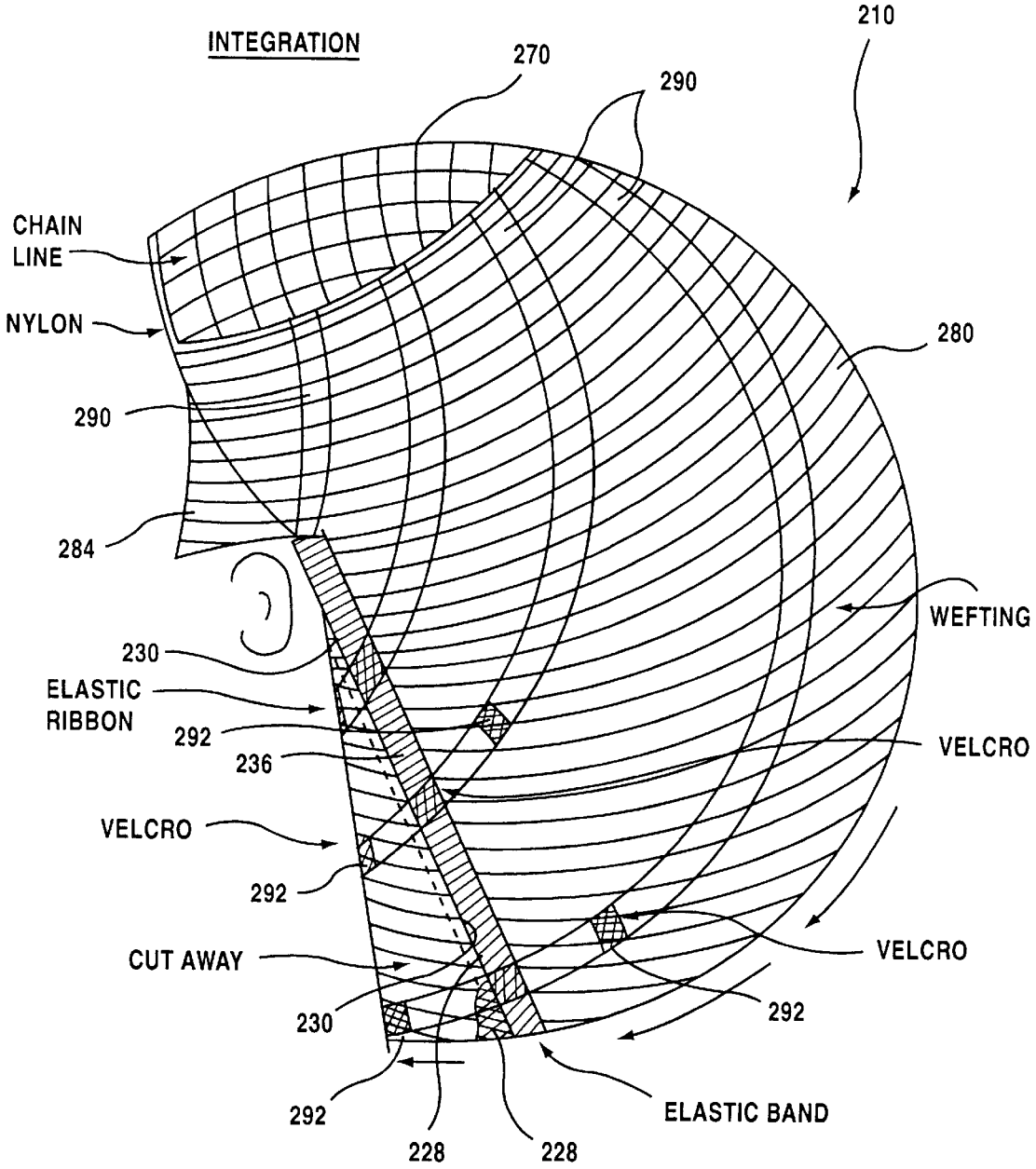
FIG. 12 is a side view of the embodiment of FIG. 11 with the hair mounting sheet removed, having the integration chain line at the central mesh region.
Figure 14:
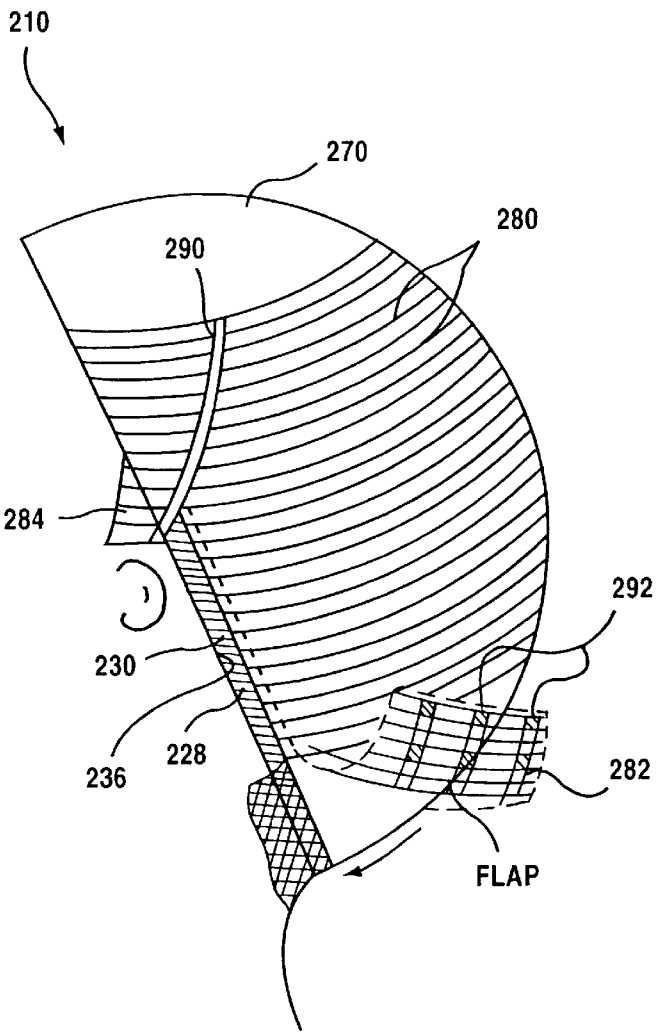
FIG. 14 is a view as in FIG. 12, without the integration chain line, and with only one of the adjustment strips attached.
Figure 13:
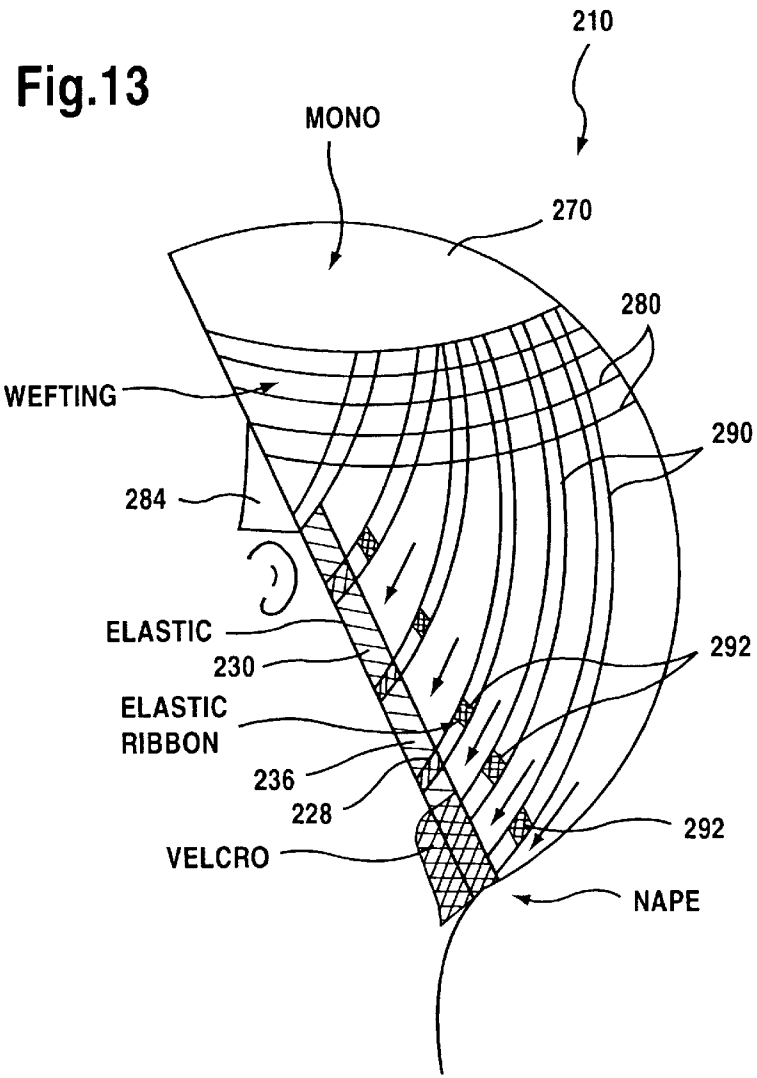
FIG. 13 is a side view as in FIG. 12, with only a portion of the wetting illustrated.
Figure 15:
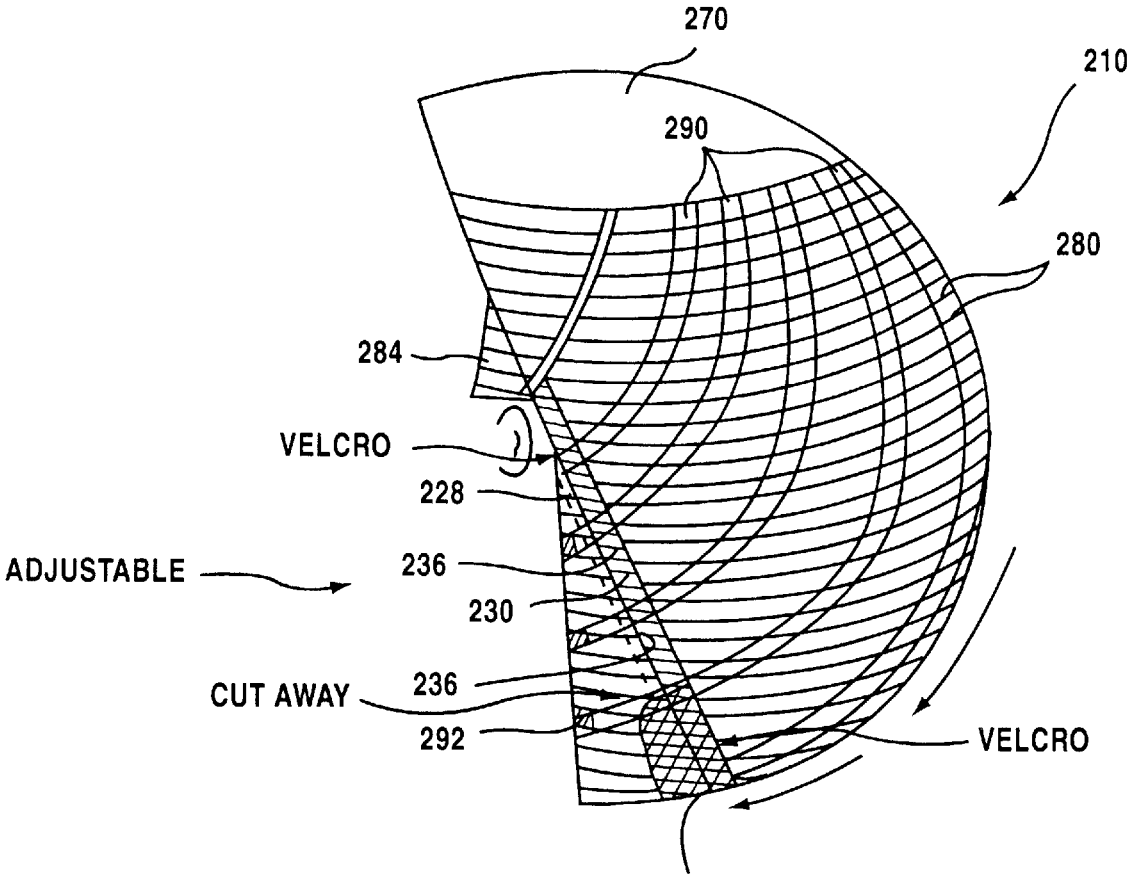
FIG. 15 is a view as in FIG. 12 without the integration at the central mesh region.
Figure 16:
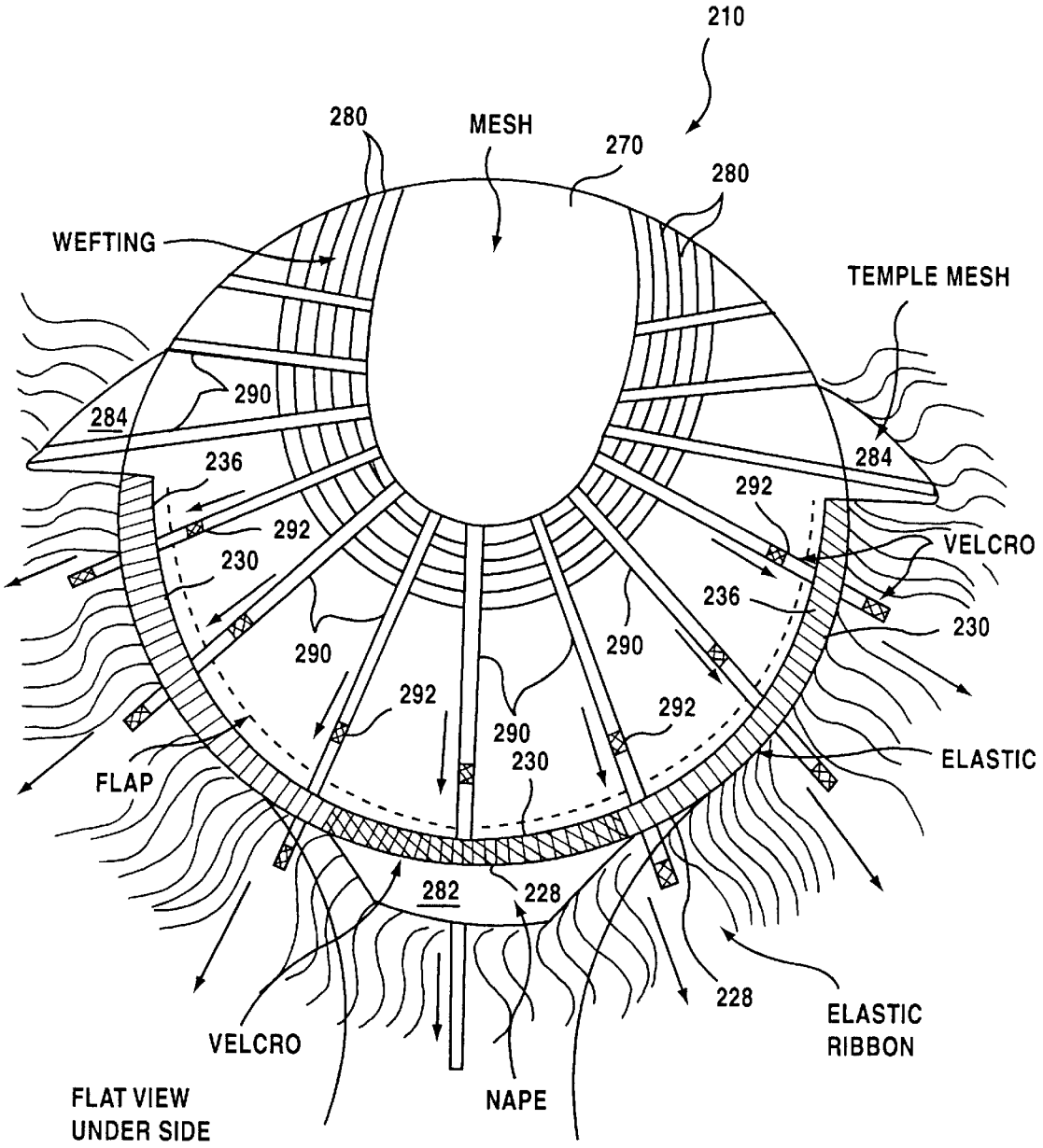
FIG. 16 is a top view of the embodiment of FIG. 11, with the hair mounting sheet mostly removed, showing with arrows the adjustment strips advancing radially underneath the loop member during fitting.

A perimeter member 130 is provided as described for the first embodiment. Net regions 114 and 116 preferably are rectangles of intersecting first net line 146 interlinked in a chain stitch. As shown in FIG. 9, guide line 142 is a segment of first net line 146 which continues to chain stitch back and forth between guide line 142 and perimeter member 130, parallel and perpendicular to guide line 142, weaving over and under itself and passing through ports 138 in perimeter member 130 to define a net with a rectangular mesh. The second net portion is strung the same way with the second net line. Draw string line 152 wraps around guide line 142 adjacent to and laterally abutting evenly spaced segments of first net line 146 folding around guide line 142, so that they provide mutual support.

Third Preferred Embodiment

Finally a wig 210 embodiment is provided for covering the scalp or a portion of the scalp with hair. See FIGS. 11–16. A perimeter member in the form of a partial loop 230 is provided which includes elastic strip side portions 236 interconnected by a hook and loop fastener strip 228 which extends along the lower faces of side portions 236. A central mesh region 270 is provided at the top of the scalp and concentric lines of wefting 280 encircle and progress outwardly and downwardly from the mesh region 270 to the vicinity of perimeter member 230. Hair strands 14 are secured to the wefting Elastic adjustment strips 290 cross and are secured to the wefting 280 lines, and extend radially outward from the innermost wefting 280 lines and pass underneath the perimeter member 230. A regularly spaced series of hook and loop fastener patches 292 is secured to the upper surface of each adjustment strip 290 for selective engagement with the perimeter member hook and loop fastener strip 228. A hair strand covered wefting flap 282 is connected to the underlying wefting 280 and extends across and downwardly from perimeter member 230.

For custom fitting, wig 210 is placed loosely over the individual wearer head and the adjustment strips 290 together with attached wefting 280 are pulled downwardly until the wig 210 closely and even fits the head. Then fastener patches 292 immediately adjacent to perimeter member 230 are pressed into engaging contact with perimeter member 230. Adjustment strips 290 are then permanently secured to perimeter member 230 such as by stitching together. The wefting 280 protruding below perimeter member 230 is trimmed away with scissors. The hair strand 14 covered wefting flap 282 covers and conceals perimeter member 230.

Two versions of wig 210 are provided. One has only a mesh of lines at the central mesh region 270 through which existing wearer hair is passed. Mesh tabs 284 are also preferably provided at the temples. The other version has an integrated central mesh region 270 covered with hair strands. For purposes of this application, the terms hair strands and hairlike strands refer to strands of natural or artificial hair.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. An adjustable hairpiece, comprising:

a flexible perimeter member for fitting around a wearer head;

hair mounting means;

a draw member extending across at least one point on said perimeter member;

draw member fastening means for securing said draw member to said flexible perimeter member at any one of a plurality of longitudinally distributed points along said draw member;

and a plurality of hairlike strands connected to said hair mounting means;

and a guide line connected to and extending between two spaced apart points on said perimeter member, wherein said draw member comprises a first draw string line wrapping in a spiral fashion in one direction around said guide line and around an opposing first segment of said perimeter member in a spiral fashion such that pulling an end of said draw string line draws said guide line and said first segment of said perimeter member toward each other, to fit said hairpiece to a wearer head.

2. A hairpiece according to claim 1, wherein said guide line is a first guide line, said hairpiece additionally comprising a second said guide line, wherein said first and second guide lines are laterally spaced apart and each is connected to and extends between two spaced apart points on said perimeter member, wherein said first draw string line wraps around said first and second guide lines in a spiral fashion in one direction, and wraps around said first said guide line and an opposing first segment of said perimeter member in a spiral fashion, such that pulling an end of said draw string line draws said guide lines toward each other and draws said first guide line and said first segment of said perimeter member toward each other, to fit said hairpiece to the head of a wearer.

3. A hairpiece according to claim 1, wherein said hair mounting means comprises said draw member.

4. A hairpiece according to claim 2, additionally comprising a second draw string line wherein said second draw string line wraps around said guide lines in a spiral fashion in one direction, and wraps around said second guide line and an opposing second segment of said perimeter member in a spiral fashion, such that pulling an end of said second draw string line draws said guide lines toward each other and draws said second guide line and said second segment of said perimeter member toward each other, to fit said hairpiece to the head of a wearer.

5. A hairpiece according to claim 4, wherein said perimeter member comprises an elongate mesh member having a longitudinal series of mesh member ports for receiving said first and second draw string lines.

6. A hairpiece according to claim 5, wherein said perimeter member further comprises an elastic segment for drawing said perimeter member snugly around the head of wearer.

7. A hairpiece according to claim 2, wherein said draw member fastening means comprises a knot tied in said draw string line.

8. A hairpiece according to claim 1, additionally comprising lines of wefting between which the hair strands of a wearer passes, and wherein said plurality of hairlike strands are mounted onto said lines of wefting in elongate rows for interspersion among hair strands of the wearer.

9. A hairpiece according to claim 1, additionally comprising first and second laterally spaced apart guide lines connected to and extending between two spaced apart points on said perimeter member, wherein said draw member comprises a first draw string line wrapping around said first and second guide lines in a spiral fashion in one direction.

10. An adjustable hairpiece, comprising:

a flexible perimeter member for fitting around a wearer head;

hair mounting means;

a draw member extending across at least one point on said perimeter member;

draw member fastening means for securing said draw member to said flexible perimeter member at any one of a plurality of longitudinally distributed points along said draw member;

a plurality of hairlike strands connected to said hair mounting means;

and first and second laterally spaced apart guide lines connected to and extending between two spaced apart points on said perimeter member, wherein said draw member comprises a first draw string line wrapping around said first and second guide lines in a spiral fashion in one direction, and wrapping around said first said guide line and an opposing first segment of said perimeter member in a spiral fashion, such that pulling an end of said draw string line draws said guide lines toward each other and draws said first guide line and said first segment of said perimeter member toward each other, to fit said hairpiece to a wearer head.

11. A hairpiece according to claim 10, wherein said hair mounting means comprises said draw member.

12. A hairpiece according to claim 10, additionally comprising a second draw string line wherein said second draw string line wraps around said guide lines in a spiral fashion in one direction, and wraps around said second guide line and an opposing second segment of said perimeter member in a spiral fashion, such that pulling an end of said second draw string line draws said guide lines toward each other and draws said second guide line and said second segment of said perimeter member toward each other, to fit said hairpiece to the head of a wearer.

13. A hairpiece according to claim 12, wherein said perimeter member comprises an elongate mesh member having a longitudinal series of mesh member ports for receiving said first and second draw string lines.

14. A hairpiece according to claim 12, wherein said perimeter member further comprises an elastic segment for drawing said perimeter member snugly around the head of wearer.

15. An adjustable hairpiece, comprising:

a flexible perimeter member for fitting around a wearer head;

hair mounting means;

a draw member extending across at least one point on said perimeter member;

draw member fastening means for securing said draw member to said flexible perimeter member at any one of a plurality of longitudinally distributed points along said draw member;

a plurality of hairlike strands connected to said hair mounting means;

wherein said draw member comprises a flexible strip extending radially across said perimeter member;

a central scalp loop member secured to, and from which, said flexible strip extends;

and netting secured to and extending within said central scalp loop member;

wherein said hair mounting means comprises a flexible hair mounting sheet for covering at least a portion of the wearer scalp, and wherein said hairlike strands cover at least a portion of said mounting sheet.

16. An adjustable hairpiece, comprising:

a flexible perimeter member for fitting around a wearer head;

hair mounting means;

a draw member extending across at least one point on said perimeter member;

draw member fastening means for securing said draw member to said flexible perimeter member at any one of a plurality of longitudinally distributed points along said draw member;

a plurality of hairlike strands connected to said hair mounting means;

and first and second laterally spaced apart guide lines connected to and extending between two spaced apart points on said perimeter member, wherein said draw member comprises a first draw string line wrapping around said first and second guide lines in a spiral fashion in one direction.

* * * * *